United States Patent [19]

Clinton

[11] 4,387,665

[45] Jun. 14, 1983

[54] ELECTRONIC BAND MARKING CONTROLLER

[76] Inventor: Henry H. Clinton, 10 Shore Rd., Clinton, Conn. 06413

[21] Appl. No.: 291,612

[22] Filed: Aug. 10, 1981

[51] Int. Cl.[3] ..... B05B 3/14

[52] U.S. Cl. ..... 118/674; 118/314; 118/325; 118/DIG. 21

[58] Field of Search ..... 118/674, 624, 625, 629, 118/630, 314, DIG. 21, 325; 307/262; 328/155

[56] References Cited

U.S. PATENT DOCUMENTS 2,428,284 9/1947 Krogel ..... 118/325 X
4,041,894 8/1977 Kimmich ..... 118/674

FOREIGN PATENT DOCUMENTS 950571 4/1961 United Kingdom ..... 118/DIG. 21

*Primary Examiner*—John P. McIntosh

*Assistant Examiner*—Mary Beth Calligaris

*Attorney, Agent, or Firm*—McCormick, Paulding & Huber

[57] ABSTRACT

A band marking apparatus for producing marking bands at spaced intervals along an insulated wire employs two ink jet dispensers located on opposite sides of the moving wire at longitudinally spaced stations. The dispensers are driven in an oscillatory manner by means of a tachometer engaged with the wire so that the marking bands are produced at uniform intervals regardless of the speed of movement of the wire past the dispensers. To insure proper registration of the band segments produced by the respective dispensers on opposite sides of the wire, an electronic controller for the dispensers includes an adjustable phase selector to regulate the phase relationship of the oscillating dispensers. The controller also includes other circuitry to maintain linear signal relationships and to center the oscillations of the respective dispensers on the wire.

14 Claims, 3 Drawing Figures

ELECTRONIC BAND MARKING CONTROLLER

BACKGROUND OF THE INVENTION

The present invention relates to marking devices and is concerned in particular with an apparatus that produces marking bands along insulated wires, cables, conduits and the like.

In the production of a multi-conductor cable, composed of individually insulated wires, it is usually necessary to provide a way of distinguishing each conductor from all of the others to facilitate rapid and accurate connections when the cable is installed. Many means of accomplishing this end have been used, including the use of insulating compounds of different colors, marking devices which stripe or periodically band each insulated wire with inks of contrasting colors, or other marking devices which periodically print a series of numbers and letters on the insulation, again in contrasting colors.

Using different color insulations is simplest, but limits the number of readily distinguishable conductors in a cable. For cables with large numbers of conductors, several of the marking schemes must be used in combination. Most marking methods require the conductor to come into contact with a print wheel and use slow-drying inks. This process limits wire line speeds to under a few hundred feet per minute and is therefore expensive.

A newer process in use for several years allows closely spaced color bands to be applied to insulated wire moving at high extrusion speeds. This technique employs an ink jet dispenser which is rapidly oscillated alternately above and below the axis of the insulated wire as it emerges from the extruder head. A semicircular segment of a band is applied to the insulation each time the ink jet crosses the wire. Since the insulating compound at this point is not yet cooled below its melting point, a fast-drying ink which amalgamates with the compound can be used. Drying and amalgamation are complete before the product enters a water cooling trough which is located downstream of the extruder in the wire production line.

Since the process just described only covers 180 degrees of the wire circumference, a second jet dispenser oscillating in synchronism with the first is directed at the opposite side of the wire to complete the band. The ink dispensers cannot be located directly opposite each other, since the ink jets would interfere with one another. One dispenser is therefore displaced longitudinally along the wire line by a multiple of the spaces between the bands. A mechanical adjustment of the dispensers is customarily provided to allow this displacement to be varied by a small amount which brings the two band segments into exact alignment.

Each ink jet dispenser is oscillated through an angle of approximately 20 degrees or so by a transducer comprised of a permanent magnet cyclically driven in the alternating field of an electromagnet. The permanent magnet is resiliently restrained by a torsion spring to oscillate with the alternating field, and the mechanically resonant frequency of the moving assembly is set substantially higher than the highest required driving frequency. The rotational oscillations of the magnet are conveyed to an ink jet nozzle by means of a shaft which is supported in a bearing. The permanent magnet is supported within the driving electromagnetic structure by means of this bearing and by the torsion spring. The design of the transducer is such that its instantaneous angle of rotation is directly proportional to the instantaneous magnitude of the alternating current in the electromagnet coil.

The alternating driving current for the electromagnet is obtained from an amplifier, which in turn is driven by an AC tachometer rotated by the moving wire. Since the tachometer output frequency is proportional to the wire speed, the frequency of oscillation of the ink nozzles is also directly proportional to wire speed. Thus, the average spacing of the bands is independent of wire speed, and depends only on the constant of proportionality between wire speed and tachometer output frequency.

A number of adjustments are necessary to obtain satisfactory operation of the prior art system described above. The midpoint of the oscillation must coincide with the wire axis to avoid alternate narrow and wide spacing of the bands. Adjustment of this midpoint can be achieved by superimposing a direct current on the alternating current for each transducer to produce the required average deflection.

The distance between the oscillating jets is varied by mechanical means to bring the two half segments of each band into coincidence.

The gain of the system amplifiers must be set so as not to distort the alternating driving signals. Even order distortion in particular must be avoided, since this shifts the zero offset as amplitude changes. The voltage output from the tachometer is linearly related to frequency. The impedance of the electromagnetic transducer, however, is not a simple function of frequency. As a result, it is necessary to manually adjust amplifier gains as line speed varies.

In designs of the system now available, all the various adjustments must be made in accordance with visual observation of the ink jets under a stroboscope. The two ink jets require an amplifier gain adjustment, two amplitude adjustments, two centering adjustments, and a mechanical alignment to match segments of each marking band, all by stroboscopic observation. Since the burden of these adjustments falls upon the extruder operator who may not fully comprehend which adjustment to make for a given deviation from normal marking, the result is usually marking of poor and variable quality.

It is accordingly a general object of the present invention to provide an improved band marking controller which eliminates the possibility of distorting the electrical signal in the amplifier, eliminates the mechanical band segment alignment adjustment after initial setting, reduces the need for frequent adjustment as wire line speed changes, and provides separate indicators of amplitude and centering for each ink jet. The improved controller allows a relatively unskilled operator to consistently produce properly banded wire.

SUMMARY OF THE INVENTION

The present invention resides in an apparatus for producing marking bands at spaced intervals along a wire or like object. The apparatus includes cyclically driven dispensers for applying marking material to different sides of the wire and at longitudinally spaced stations along the wire as the wire passes the marking apparatus. Speed sensing means are provided for sensing the speed of movement of the wire longitudinally relative to the dispensers and for generating a synchronous speed signal for operating the dispensers at a cyclic rate proportional to the speed of movement. The sensor may, for example, comprise a tachometer that is in contact with and is rotated by the wire.

The invention relates to an improved controller responsive to the speed signal and connected in driving relationship with the cyclically driven dispensers. The controller comprises phasing circuit means connected with the speed sensing means for generating from the speed signal two synchronous speed signals in fixed phased relationship. Adjustable phase selecting means are connected with the phasing circuit means and have two outputs providing respectively two synchronous speed signals of selected phase relationship. For example, the phasing circuit means may be a constant phase network of the type used in a single side band transmitters to generate a pair of signals in phase quadrature for modulation of a carrier. The adjustable phase selecting means may be a pair of potentiometers excited by the speed signals in fixed phase relationship to produce two synchronous signals having a phase relationship depending upon the setting of the two potentiometers.

Two drive amplifiers are connected respectively to the cyclically driven dispensers and are responsive to the synchronous speed signals of selected phase relationship. The oscillations of the dispensers and the corresponding bands produced on different sides of the wire can be shifted slightly relative to one another by adjusting the phase relationship of the synchronous signals driving the dispensers. Consequently, adjustment of the phase relationship can be accomplished electrically while the apparatus is operating to bring the segments of a marking band on different sides of the wire into precise positional correspondence.

DESCRIPTION OF THE PREFERRED EMBODIMENTS

Figure 1:
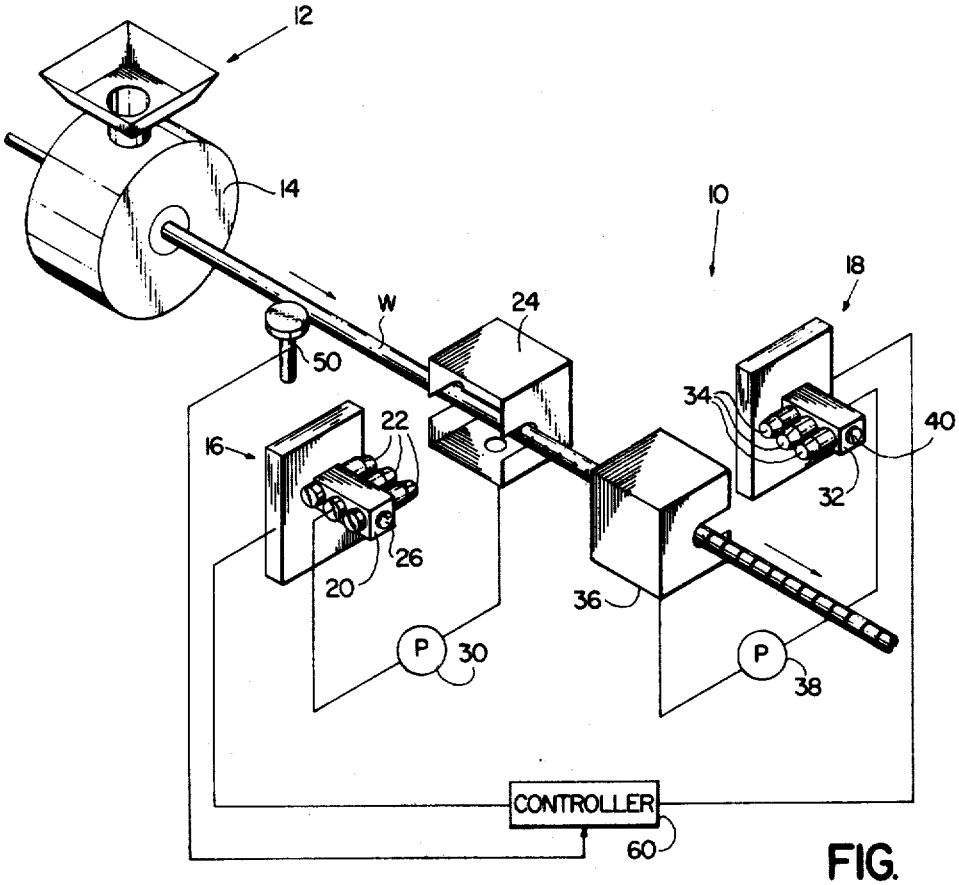
FIG. 1 is a perspective view that schematically illustrates the band marking apparatus along a wire production line downstream of an extruder that forms a layer of insulation on the wire.

FIG. 1 illustrates a marking apparatus, generally designated 10 for producing marking bands at longitudinally spaced intervals along an insulated wire W. The apparatus is located along the production line for the wire, which moves in the direction of the arrows, and is immediately downstream of an extruder 12 which applies a plastic or other compound to the exterior of the bare wire for electrical insulation. The apparatus is located close to the extruder head 14 so that the marking material can be applied to the insulation before the insulation has set. Preferably the material is a fast-drying ink which amalgamates with the insulation compound to produce a permanent marking band in the outer surface of the insulation. Downstream of the marking apparatus the wire passes through a cooling trough (not shown) to accelerate the setting of the insulation after the marking bands have been applied.

Figure 2:
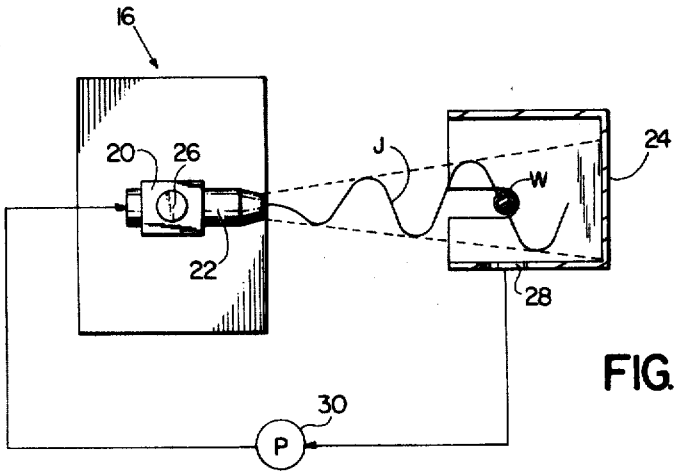
FIG. 2 is an elevation view of one ink jet dispenser shown in the apparatus of FIG. 1 and illustrates the manner in which a marking material is applied to the insulated wire.

The marking apparatus 10 is comprised of two marking material instruments or dispensers 16 and 18 that are located at longitudinally spaced stations along the wire production line. The dispenser 16 is an oscillating ink jet dispenser having a dispensing head 20 with triple jet nozzles 22. The nozzles are aimed generally toward a spray shield 24, and each nozzle emits a continuous ink jet J toward the shield as the head 20 is oscillated by a drive shaft 26. The amplitude of the oscillations is illustrated by the jet J in FIG. 2 and is limited so that the jets from the nozzles are confined within the spray shield 24. Spray shield 24 straddles the insulated wire W and contains a drain 28 in the bottom wall to return unused ink or other fluid marking material to a recirculation pump and reservoir 30. The pump in turn supplies pressurized marking ink to each of the nozzles 22 in the head 20.

The dispenser 18 has substantially the same construction as the dispenser 16 but is located on the opposite side of the wire W at a position downstream from the dispenser 16. The dispenser 18 includes an oscillating head 32 with triple dispensing nozzles 34, a spray shield 36 and a recirculation pump and reservoir 38. The head 32 is mounted on a drive shaft 40 for oscillation of the nozzles in the same manner as the dispenser 16 illustrated in FIG. 2. Since the pumps and reservoirs 30 and 38 receive and deliver the same marking fluid to each of the heads 20, 32, their function can be performed by a single pump if desired.

In order to generate the marking bands at uniformly spaced intervals along the wire W, the oscillating heads 20, 32 are driven at a frequency that is dependent upon the speed of the wire from the extruder 12. For this purpose, a speed sensing means or tachometer 50 is mounted in engagement with the wire which moves past the dispensers. The tachometer produces an alternating signal in synchronism with the speed of the wire and the synchronous speed signal becomes the primary drive signal for the oscillating heads. Accordingly, the signal produced by the tachometer is a sychronous speed signal, and the spacing of the marking bands produced on the wire remains uniform even though the extrusion speeds of the wire may vary.

It will be observed that the marking bands are only partially formed on the segment of the wire extending between the shields 24 and 26 due to the fact that the nozzles 22 can only dispense the marking ink on one side of the wire as it passes through the shield 24. The remaining portion of the marking bands is generated by the nozzles 34 which dispense the ink on the opposite side of the wire as it passes through the shield 36. Thus, the bands illustrated on the segment of the wire downstream of the shield 36 are fully formed.

The dispenser 18 with the three nozzles 34 must be driven not only in synchronism with the dispenser 16, but also in phased relationship with the dispenser 16 so that the two segments of any given marking band are generated on diametrically opposite areas of the wire. It is desirable to drive both sets of nozzles 22, 34 with a minimum of phase difference from each other so that vertical shifting or flapping of the moving wire relative to the center of nozzle oscillations causes the positional displacement of the band segments generated by the dispenser 16 to be the same as the positional displacements of the band segments produced by the dispenser 18. For this reason, the dispensers 16 and 18 are mechanically positioned along the wire W so that the distance between the dispensers is approximately equal to a whole number of three-band groups or cycles of operation. With such positioning, the three semicircular band segments produced as a group by the nozzles 22 will ideally be brought into registration respectively with the three semicircular marking segments produced by the nozzles 34, one or more cycles of operation later.

Due to factors such as the mounting of the nozzles on the drive shafts and other factors which influence the mechanical and electrical centers of oscillation, small variations in the placement of the semicircular marking segments at opposite sides of the wire may occur and produce visible discontinuities in the marking bands. Accordingly, the marking apparatus 10 is provided with a controller 60 that enables the phase relationship of the oscillating heads 20, 32 to be precisely adjusted and to thereby bring about an accurate correspondence of the marking segments on both sides of the wire.

Figure 3:
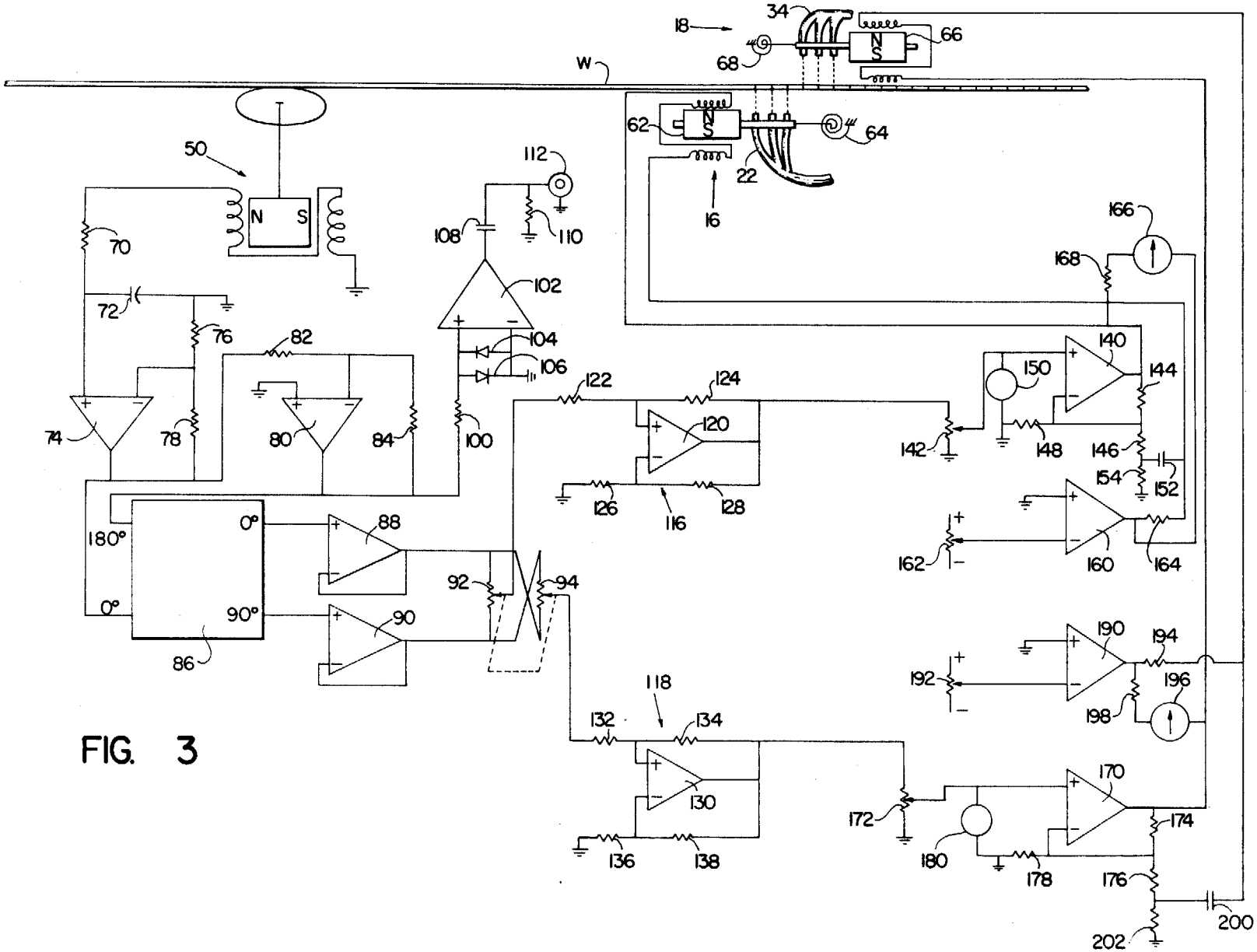
FIG. 3 is an electrical schematic of the marking apparatus and discloses the improved controller of the present invention.

The details of the controller 60 and the connections with the dispensers 16 and 18 are illustrated in FIG. 3.

In FIG. 3, the tachometer 50 is illustrated as an electromagnetic device that produces an AC signal at a frequency that is dependent upon the speed of the wire moving past the dispensers 16 and 18. This AC signal is a synchronous speed signal that is used to drive electromagnetic transducers or drive motors 62, 66 in a oscillatory manner in each of the dispensers. The drive motor 62 in the dispenser 16 consists of a permanent magnet and two field coils which rotate the drive shaft on which the nozzles are mounted in an oscillatory manner in conjunction with the torsion spring 64. The drive motor 66 in the dispenser 18 is similarly constructed and oscillates the nozzles 34 in conjunction with the torsion spring 68. As stated above, the instantaneous current through the field coils determines the instantaneous angle of rotation of the drive shaft and the nozzles.

The illustrated electromechanical tachometer 50 produces AC signals which vary not only in frequency with the speed of the cable, but also in amplitude. Such variations in amplitude are not desired in the driving signal applied to the motors 62 and 66, and for this reason, the output of the tachometer is applied to an amplitude leveling circuit formed by the integrating resistor 70 and capacitor 72. This RC circuit tends to level the amplitude variations due to the fact that the reactance of the capacitor 72 is inversely proportional to the frequency of the signal, and since the signal amplitude increases with frequency, the decreasing reactance has the tendency to reduce the level of the signal applied to operational amplifier 74. The fixed voltage gain of the amplifier is determined and controlled by the negative feedback resistors 76, 78. The output of amplifier 74 is applied to the negative input of an operational amplifier 80 which inverts the signal and provides a voltage gain determined by the resistors 82 and 84.

Both the non-inverted signal from the amplifier 74 and the inverted signal from the amplifier 80 are applied to their respective inputs of a constant phase shift circuit 86. The output signals from the circuit 86 are as indicated in FIG. 3, the non-inverted signal at a zero degree reference phase and a corresponding signal shifted 90 degrees from the zero degree phase signal. The phase shift circuit 86 is a circuit that produces as outputs the two signals in fixed phased relationship and the signals are stable in phase and amplitude over a wide range of frequencies. A well known circuit of this type is a phase quadrature circuit most commonly employed in single sideband transmitters to produce a pair of signals in phase quadrature for modulation of a carrier wave. One particular circuit is disclosed in the publication, *General Electric Ham News*, November 1950, and is called SSB, Jr.

The two fixed phase signals from the circuit 86 are applied respectively to amplifiers 88 and 90 having a unity gain and are employed to excite the windings of potentiometers 92 and 94. The potentiometers are ganged as a dual potentiometer with the winding of potentiometer 94 connected in oppositely phased relationship from the potentiometer 92. Accordingly, as the wipers of potentiometers are moved toward the upper ends of the windings, the potentiometer 92 produces an alternating output signal substantially at the zero phase angle while the potentiometer 94 produces an output signal at the 90 degree phase angle. Both the signals are in synchronism with the signal from the tachometer 50 but differ in phase by 90 degrees.

As the wipers of the potentiometers 92 and 94 are moved toward the opposite, lower ends of the windings, the phase angle between the two synchronous output signals is reduced until there is zero phase difference between the signals at the midpoints of the windings. At this point, the difference in phase of the signals reverses and increases in the opposite sense as the wipers approach the opposite ends of the respective windings. Accordingly, the two synchronous signals produced by the potentiometers have a phase difference selected according to the positioning of the ganged wipers of the potentiometers 92, 94, and the lead/lag relationship of the signals may be adjusted over a range between +90 degrees and −90 degrees.

The adjustment of potentiometers 92 and 94 is employed to make small phase changes in the oscillations of the jet nozzles 22 and 34 for more precise registration of the respective segments of the marking bands. This adjustment is accomplished either through visual observation of the marking bands on the wire W or preferably through stroboscopic examination of the ink jets as the bands are applied to the wire. For stroboscopic examination, timing signals are derived from the tachometer 50 through the output of amplifier 80 and are applied through a resistor 100 and a pair of clipping diodes 104,106 to an operational amplifier 102. The output of the amplifier 102 is differentiated by means of the capacitor 108 and resistor 110 and provides a sequence of timing pulses at the instrumentation jack 112. By connecting a strobe light to the jack 112 and shining the light on the wire W as the ink jets from nozzles 34 oscillate across the wire, the dual potentiometers 92 and 94 can be adjusted so that the ink jets from the nozzles 34 strike the wire W as the band segments from the nozzles 22 pass in front of the nozzles 34. The dual potentiometers effectively serve as a band segment alignment circuit or a balance circuit for the synchronous signals driving the respective motors.

Although the amplitudes of the synchronous signals produced from the constant phase network 86 are uniform over a broad range of frequencies, the amplitudes of the signals of selected phase relationship produced by the potentiometers 92, 94 vary between the full voltage produced by the amplifiers 88, 90 when the ganged wipers are positioned at the ends of the potentiometer windings and 0.707 times the full voltage when the wipers are at the midpoints of the windings. Since it is desirable to maintain a uniform signal amplitude throughout the controller for purposes of linearity and avoiding distortion, the phase adjusted signals are applied to normalizing circuits 116 and 118 respectively. The circuit 116 is comprised by an operational amplifier having positive feedback through resistors 122 and 124 and negative feedback through resistors 126 and 128. With such a circuit, the overall gain of the amplifier varies with the level of the signal from the potentiometers 92, 94. The gain increases from a unity level when the potentiometers are at either end of the windings to 1.414 when the wipers are at the midpoint of the windings. Accordingly, the amplitude of the signal at the output of the normalizing circuit 116 is uniform regardless of the adjustment of the potentiometers, but the signal is shifted in phase in accordance with the adjustment of the potentiometers.

The normalizing circuit 118 has the same construction as the circuit 116 and operates in the same manner. The operational amplifier 130 has positive feedback resistors 132 and 134 and negative feedback resistors 136 and 138.

Accordingly, the synchronous signals which are shifted in phase by the potentiometers 92, 94 have amplitudes that are normalized by the circuits 116 and 118.

The phase adjusted signal from the circuit 116 is transmitted through a signal amplitude adjusting potentiometer 142 to a drive amplifier 140 connected with the oscillatory motor 62. The potentiometer 142 allows fine adjustments in the amplitude of the motor oscillations to be made. The amplifier 140 has negative feedback provided by resistors 144, 146 and 148. The feedback maintains linearity between the input voltage from the potentiometer 142 and the current energizing the field coils of the motor 62 independently of coil impedance or frequency of operation. This linearity is desirable to produce nozzle oscillations of reasonably constant amplitude over a wide range of wire speeds. An AC meter 150 may be included to measure the amplitude of the voltage signal driving the amplifier 140.

Most of the AC current driving the motor 62 is returned to ground through the capacitor 152 and the resistor 154.

At the center of nozzle oscillations, the nozzles should be aimed directly at the wire W to insure that the marking bands are evenly spaced along the wire. Since the mechanical and electrical components controlling the oscillations introduce errors that may shift the center of the oscillations, trimming amplifier 160 is employed to provide a DC centering current in accordance with the voltage provided by the DC potentiometer 162. The amplifier 160 is connected in driving relationship with the field coils of the motor 62 through the summing resistor 164. As the DC voltage level from the potentiometer 162 is varied, the steady state or current position of the motor 62 is adjusted while the AC driving current from amplifier 140 is superimposed on the DC current. The centering current can be read by a zero-center meter 166 connected between the outputs of the amplifiers 140 and 160 with the limiting resistor 168.

The drive components for the oscillating motor 66 are identical with those for the motor 62. The phased synchronous signal from the circuit 118 is applied to the drive amplifier 170 through the signal level potentiometer 172. The amplifier has negative feedback provided by resistors 174, 176, 178. The amplitude of the drive voltage can be monitored through the meter 180.

DC centering current is produced by the drive amplifier 190 and potentiometer 192. The amplifier is connected through the resistor 194 with the field coils of the motor 66, and the level of the centering current can be monitored through the zerocenter meter 196 having the limiting resistor 198. Most of the driving current is returned to ground through the capacitor 200 and the ground resistor 202.

Initially, the band marking apparatus is coarsely calibrated by driving the dispensers in phase with one another and spacing the dispensers so that the different segments of the marking bands are substantially in correspondence. The amplitudes of the oscillations are made uniform through the adjustment of signal level potentiometers 142, 192, and the oscillations are centered on the wire by means of the potentiometers 162 and 172. Final phase adjustment of the oscillations to bring the marking band segments into precise correspondence is obtained through the dual potentiometers 92, 94. All of these adjustments can be performed by the machine operator with the aid of a stroboscope without the intervention of nonlinearities and the interaction of one adjustment upon another.

Accordingly, a controller of a band marking apparatus has been disclosed with means for adjusting the phase of the driving signals applied to two oscillating dispensers positioned at opposite sides of the wire being marked. The controller employs normalizing and amplitude leveling circuits to maintain linear relationships throughout the controller and to avoid signal distortions that would displace the marking band segments along the wire.

While the novel controller for the marking apparatus has been disclosed in one embodiment above, it should be understood that numerous modifications and substitutions can be had without departing from the spirit of the invention. For example, the amplitude leveling function performed by the integrating resistor 70 and capacitor 72 could also be performed by an automatic gain control circuit. Similar circuits could be utilized for the normalizing circuits 116 and 118. While ink has been suggested as a typical marking fluid, it should be understood that other types of paint or powders may also be applied to the wire. The nozzles 22, 34 are noncontact type dispensers and are preferred since they do not impose any physical restraints on the longitudinal movement of the wire in the production line; however, the controller can also be used with other types of marking instruments with similar results. The use of three nozzles collectively to generate three marks with each cycle of operation allows higher wire speeds to be achieved when the power or oscillatory characteristics of the dispensers reach an upper limit. The controller, therefore, may also be employed with single nozzle devices where the components are not so limited or high wire speeds are not employed. Accordingly, the present invention has been described in a preferred embodiment by way of illustration rather than limitation.

I claim:

1. In an apparatus for producing marking bands at spaced intervals along a wire or like object and including cyclically driven dispensers for applying marking material to different sides of the wire and at longitudinally spaced stations along the wire and speed sensing means for sensing the speed of movement of the wire longitudinally relative to the dispensers and generating a synchronous speed signal for operating the dispensers, an improved controller responsive to the speed signal and connected in driving relationship with the cyclically driven dispensers comprising:

phasing circuit means connected with the speed sensing means for generating from the synchronous speed signal two additional speed signals synchronous with the speed signal and fixed in phase relationship with each other;

adjustable phase selecting means connected with the phasing circuit means and having two inputs respectively receiving the additional speed signals and two outputs providing respectively two further synchronous speed signals of selected phase relationship; and two drive amplifiers connected respectively in driving relationship with two cyclically driven dispensers and responsive respectively to the two further synchronous speed signals of selected phase relationship.

2. In an apparatus for producing marking bands at spaced intervals along a wire or like object, the improved controller of claim 1 wherein:

the speed sensing means comprises a tachometer coupled with the wire being marked and producing a synchronous alternating signal having a frequency and amplitude proportional to the longitudinal speed of movement of the wire relative to the dispensers; and an amplitude leveling circuit is interposed between the tachometer and the phasing circuit means to supply a synchronous speed signal of substantially uniform amplitude at various wire movement speeds.

3. In an apparatus for producing marking bands on a wire or like object, the improved controller of claim 2 wherein the amplitude leveling circuit comprises an integrating RC circuit.

4. In an apparatus for producing marking bands at spaced intervals along a wire or like object, the improved controller of claim 1 wherein the adjustable phase selecting means comprises a balance circuit connected with the phasing circuit means and energized by the two additional synchronous speed signals in fixed phase relationship for selecting the phase relationship of the two further synchronous speed signals at the respective outputs.

5. In an apparatus for producing marking bands at spaced intervals, the improved controller of claim 4 wherein the balance circuit comprises dual potentiometers, each energized by the two additional synchronous speed signals in fixed phase relationship and ganged with oppositely phased operation to produce the two further synchronous signals of selected phase relationship.

6. In an apparatus for producing marking bands, the improved controller of claim 5 further including normalizing circuit means connected between the balance circuit and the drive amplifiers and receiving the two synchronous signals of selected phase relationship from the dual potentiometers for establishing, in conjunction with the balance circuit, signal levels of uniform magnitude for the two synchronous speed signals of selected phase relationship driving the dispensers through the amplifiers.

7. In an apparatus for producing marking bands, the improved controller of claim 6 wherein the drive amplifiers have negative feedback for linear driving characteristics.

8. In an apparatus for producing marking bands along a wire or like object, an improved controller as defined in claim 1 wherein the cyclically driven dispensers include oscillating drive motors having an adjustable center of oscillation; and further including centering means connected with the two cyclically driven dispensers for adjusting the center of oscillation of the drive motors relative to the center of the wire or like object.

9. In an apparatus for producing marking bands along a wire or like object, an improved controller as defined in claim 1 wherein each of the cyclically driven dispensers includes a plurality of marking instruments for producing a corresponding plurality of longitudinally spaced marking bands on the wire in a single cycle; and the adjustable phase selecting means is adjusted to establish a phase relationship matching the plurality of marks produced by the instruments of one dispenser in one cycle with the plurality of marks produced by the instruments of the other dispenser in one cycle.

10. In an apparatus for producing marking bands on a wire or like object, the improved controller of claim 1 wherein the phasing circuit means comprises a phase quadrature circuit.

11. In a marking apparatus for producing marking bands on a moving wire or the like including two oscillatory marking material dispensers mounted at opposite sides of the wire and at longitudinally spaced stations along the wire, the dispensers being driven sinusoidally at a frequency determined by a speed sensor coupled with the wire, an improved phasing controller for adjusting the phase relationship of the oscillatory dispensers to bring the marks produced on opposite sides of the wire by the dispensers into uniform and corresponding positional relationship, comprising:

a constant phase shift circuit connected with the speed sensor and producing two synchronous signals having a fixed phase relationship over a broad range of speeds; and phase selector means connected with the constant phase shift circuit for excitation by the two synchronous signals of fixed phase relationship, the phase selector means being adjustable to generate two further synchronous signals of selected phase relationship for driving the oscillatory dispensers synchronously with the speed sensor and with a phase relationship corresponding to the two further synchronous signals.

12. In a marking apparatus for producing marking bands on a moving wire or the like, the improved phasing controller of claim 11 wherein the phase selector circuit comprises dual potentiometers excited by the two synchronous signals of fixed phase relationship and providing respectively as outputs the two further signals of selected phase relationship.

13. In a marking apparatus for producing marking bands on a moving wire or the like, the improved phasing controller of claim 11 wherein:

the oscillatory marking material dispensers include electromagnetically driven motors and operate about a center of oscillation; and centering means are provided in the controller for adjusting the center of oscillation.

14. In a marking apparatus for producing marking bands on a moving wire or the like, the improved phasing controller of claim 11 further including means for adjusting the amplitude of the oscillations of one dispenser.

* * * * *